US009415504B2

(12) United States Patent
Chen

(10) Patent No.: US 9,415,504 B2
(45) Date of Patent: Aug. 16, 2016

(54) TOOL BOX UNIT

(71) Applicant: Chao-Ming Chen, Taichung (TW)

(72) Inventor: Chao-Ming Chen, Taichung (TW)

( * ) Notice: Subject to any disclaimer, the term of this patent is extended or adjusted under 35 U.S.C. 154(b) by 237 days.

(21) Appl. No.: 14/326,271

(22) Filed: Jul. 8, 2014

(65) Prior Publication Data

US 2016/0008972 A1 Jan. 14, 2016

(51) Int. Cl.
*B25H 3/02* (2006.01)

(52) U.S. Cl.
CPC . *B25H 3/023* (2013.01); *B25H 3/02* (2013.01)

(58) Field of Classification Search
CPC ..... A47B 81/00; A47B 87/0207; A47B 87/0215; A47B 88/04; A47B 88/16; B25H 3/02; B25H 3/023; B65D 21/0201; B65D 21/0202; B65D 21/0204; B65D 21/0205; B65D 21/0208; B65D 21/0212; B65D 21/0223; B65D 21/0228; B65D 21/0233; B65D 21/032
USPC ..... 206/349, 373, 503–509; 220/23.6, 220/23.83, 23.86; 312/107–111, 330.1–333
See application file for complete search history.

(56) References Cited

U.S. PATENT DOCUMENTS

| | | | | |
|---|---|---|---|---|
| 5,244,265 A * | 9/1993 | Chiang | B25H 3/023 | 312/107 |
| 5,544,751 A * | 8/1996 | Klodt | B65D 21/0212 | 206/509 |
| 6,889,838 B2 * | 5/2005 | Meier | B25H 3/021 | 206/508 |
| 9,131,770 B2 * | 9/2015 | Stegherr | B65D 21/0223 | |
| 2010/0224528 A1 * | 9/2010 | Madsen | B65D 21/0213 | 206/505 |

* cited by examiner

*Primary Examiner* — Bryon Gehman

(57) ABSTRACT

A tool box unit contains: a body, at least one upper cover, at least one drawer, and a controlling mechanism. The body includes at least one first accommodating space defined therein; the at least one upper cover is rotatably fixed on an upper side of the body; the at least one drawer is slidably fixed in the at least one first accommodating space of the body and has at least one receiving portion for accommodating tools. The controlling mechanism includes at least one trench formed on two first side plates of the body, and each trench has a control member fixed therein and at least one hooking element rotatably connected with each side plate, the control member has at least one oblique push face for pushing the at least one hooking element to rotate.

10 Claims, 19 Drawing Sheets

TOOL BOX UNIT

FIELD OF THE INVENTION

The present invention relates to a tool box unit which takes tools out of the tool box unit easily.

BACKGROUND OF THE INVENTION

Referring to FIGS. 1 and 2, a conventional tool box 10 with at least one drawer contains a first body 11 and a second body 12. The first body 11 includes a first accommodating space 111 and a first cover 112 fixed thereon, a first drawer 13 with a first receiving portion 131 mounted on the first accommodating space 111 of the first body 11. The second body 12 includes a second accommodating space 121 and a second drawer 14 with a second receiving portion 141 fixed in the second accommodating space 121 of the second body 12. To assemble the first body 11 and the second body 12 together, a first locking mechanism and a second locking mechanism are arranged in the first body 11 and the second body 12, wherein the first locking mechanism includes two first lock grooves 113 defined on two sides of the first cover 112 of the first body 11, two first gripping portions 151 secured below the two first lock grooves 113, two first pressing plates 152 rotatably connected with the first body 11 and located below the two first gripping portions 151, two first hooking portions 1521 disposed on two bottom ends of the two first pressing plates 152 and corresponding to the two first lock grooves 113, and two first springs 153 defined between two first side plates 114 and the two first pressing plates 152 to push the two first pressing plates 152 to swing outwardly. In addition, the second locking mechanism includes two second lock grooves 123 defined on two top ends of two second side plates 122 of the second body 12, two second gripping portions 161 secured below the two second lock grooves 123, two second pressing plates 162 rotatably connected with the second body 12 and located below the two second gripping portions 161, two second hooking portions 1621 disposed on two bottom ends of the two second pressing plates 162 and corresponding to the two second lock grooves 123, and two second springs 163 defined between the two second side plates 122 and the two second pressing plates 162 to push the two second pressing plates 162 to swing outwardly, such that the two first hooking portions 1521 of the two first pressing plates 152 of the first body 11 retain the two second lock grooves 123 of the second body 12, thus fixing the first body 11 and the second body 12 together. When desiring to separate the first body 11 and the second body 12 from each other, the two first pressing plates 152 of the first body 11 are manually pressed inward, and the two first springs 153 push the two first hooking portions 1521 of the first pressing plates 152 to remove from the two second lock grooves 123 of the second body 12, thereafter user's hands grip the two first gripping portions 151 of the first body 11 to upwardly remove the first body 11 from the second body 12.

However, such a conventional tool box 10 has defects as follows:

1. Because the second accommodating space 121 of the second body 12 is open, when the first body 11 removes from the second body 12, the second body 12 cannot be covered by the first body 11, so tools in the second drawer 14 will fall. In other words, the second body 12 cannot be used as an independent drawer to hold the tools.

2. The tool box 10 only contains the first body 11 and the second body 12 in which the first drawer 13 and the second drawer 14 are arranged, so the user has to pull the first drawer 13 or the second drawer 14 firstly to take the tools out, thus limiting usage.

3. When separating the first body 11 from the second body 12, the user has to press the two first pressing plates 152 so that the two first hooking portions 1521 of the two first pressing plates 152 remove from the two second look grooves 123 of the second body 12, and then his/her two hands grip the two first gripping portions 151 to upwardly remove the first body 11 from the second body 12., thus causing troublesome operation.

As shown in FIGS. 3 and 4, a conventional tool box assembly 20 contains a third tool box 21 and a fourth tool box 22. The third tool box 21 and the fourth tool box 22 include a third body 211 and a fourth body 221 for accommodating tools, a third cover 212 and a fourth cover 222 rotatably coupled with the first body 211 and the fourth body 221. To assemble the third tool box 21 and the fourth tool box 22 together, a third locking mechanism and a fourth locking mechanism are arranged in the third tool box 21 and the fourth tool box 22.

The third locking mechanism includes two third lock grooves 2112 defined on two sides of two top ends of two third side plates 2111 of the third body 211, two third gripping portions 213 secured below the two third lock grooves 2112, two third pressing plates 214 rotatably connected with the two third side plates 2111 and located below the two third gripping portions 213, two third hooking portions 2141 disposed on two bottom ends of the two third pressing plates 214 and corresponding to the two third lock grooves 2112, and two third springs 215 defined between two third side plates 2111 and the two third pressing plates 214 to push the two third pressing plates 214 to swing outwardly.

In addition, the fourth locking mechanism includes two fourth lock grooves 2212 defined on two top ends of two fourth side plates 2211 of the fourth body 221, two fourth gripping portions 223 secured below the two fourth lock grooves 2212, two fourth pressing plates 224 rotatably connected with the two fourth side plates 2211 and located below the two fourth gripping portions 223, two fourth hooking portions 2241 disposed on two bottom ends of the two fourth pressing plates 224 and corresponding to the two fourth lock grooves 2212, and two fourth springs 225 defined between the two fourth side plates 2211 and the two fourth pressing plates 224 to push the two fourth pressing plates 224 to swing outwardly, such that the two third hooking portions 2241 of the two third pressing plates 224 of the third body 211 retain the two fourth lock grooves 2212 of the fourth body 221, thus fixing the third tool box 21 and the fourth tool box 22 together. When desiring to separate the third tool box 21 and the fourth tool box 22 from each other, the two third pressing plates 224 of the third body 211 are manually pressed inward, and the two third springs 225 push the two third hooking portions 2241 of the third pressing plates 224 to remove from the two fourth lock grooves 2212 of the fourth body 221, thereafter user's hands grip the two third gripping portions 223 of the third body 211 to upwardly remove the third tool box 21 from the fourth body 22.

Nevertheless, such a tool box assembly has following disadvantages:

1. Since the third cover 212 and the fourth cover 222 are rotatably coupled with the first body 211 and the fourth body 221, the use has to rotate the third cover 212 or the fourth cover 222 upwardly to take tools in the third body 211 or the fourth body 221, thereby limiting usage.

2. When desiring to separate the third tool box 21 and the fourth tool box 22 from each other, the two third pressing plates 224 of the third body 211 are manually pressed inward so that the two third hooking portions 2241 of the third pressing plates 224 remove from the two fourth lock grooves 2212 of the fourth body 221, thereafter the user's hands grip the two third gripping portions 223 to upwardly remove the third tool box 21 from the fourth body 22, thereby operating the tool box assembly inconveniently.

3. Due to the third tool box 21 is plied on the fourth cover 222 of the fourth tool box 22, when taking the tools out of the fourth tool box 22 and opening the fourth cover 222 directly, the third tool box 21 above the fourth cover 222 is turned over. And, when plural tools are piled on the fourth cover 222, the fourth cover 222 cannot be opened directly, so the user has to remove the third tool box 21 from the fourth tool box 22 firstly so that the fourth cover 222 is opened to take the tools out, and then the third tool box 21 is re-piled on the fourth tool box 22, thereby causing troublesome operation.

The present invention has arisen to mitigate and/or obviate the afore-described disadvantages.

SUMMARY OF THE INVENTION

The when pulling a control member, two tilted driving faces of the control member drive at least one hooking element to swing outwardly so as to pull a drawer outwardly, and when releasing the control member, the at least one hooking element swing inwardly to fix the drawer, thus operating the tool box unit easily.

Secondary objective of the present invention is to provide a tool box unit which can pile a plurality of tool box units together and separate the plurality of tool box units easily.

Further objective of the present invention is to provide a tool box unit which can open at least one upper cover or pull at least one drawer outwardly to take out tools easily.

Another objective of the present invention is to provide a tool box unit which when each drawer slides into a body, a retaining member moves upwardly to retain into a lock groove to fix each drawer securely, and when pulling each pull member, it presses the retaining member to move downwardly to remove from the lock groove of the body, thus pulling each drawer easily.

To obtain the above objectives, a tool box unit provided by the present invention contains: a body, at least one upper cover, at least one drawer, and a controlling mechanism.

The body includes at least one first accommodating space defined therein; the at least one upper cover is rotatably fixed on an upper side of the body; the at least one drawer is slidably fixed in the at least one first accommodating space of the body and has at least one receiving portion for accommodating tools.

The controlling mechanism includes at least one trench formed on two first side plates of the body, and each trench has a control member fixed therein and at least one hooking element rotatably connected with each side plate, the control member has at least one oblique push face for pushing the at least one hooking element to rotate.

DETAILED DESCRIPTION OF THE PREFERRED EMBODIMENTS

Figure 1:
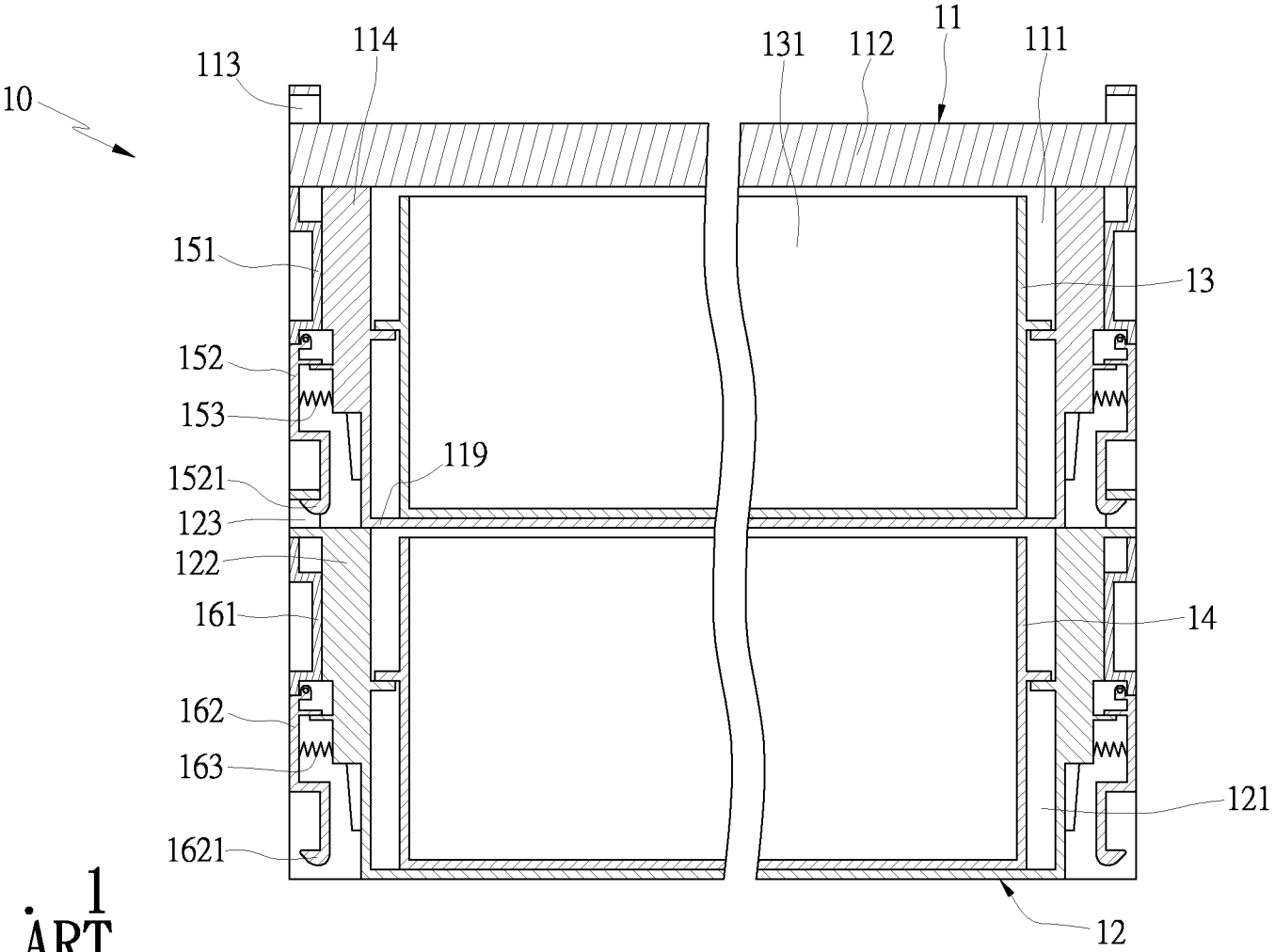
FIG. 1 PRIOR ART
FIG. 1 is a cross sectional view showing the operation of a conventional tool box with at least one drawer.
Figure 2:
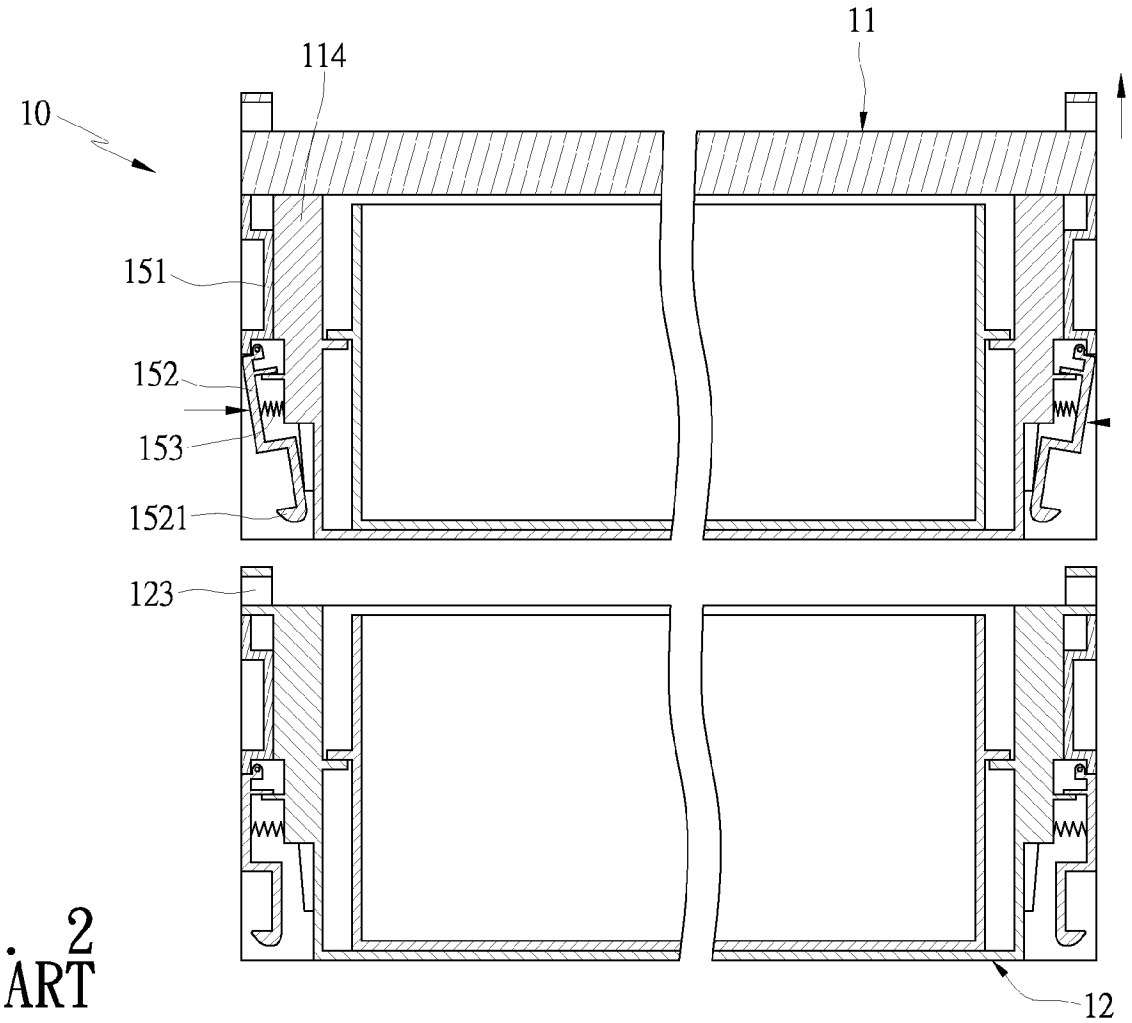
FIG. 2 PRIOR ART
FIG. 2 is another cross sectional view showing the operation of the conventional tool box with the at least one drawer.
Figure 3:
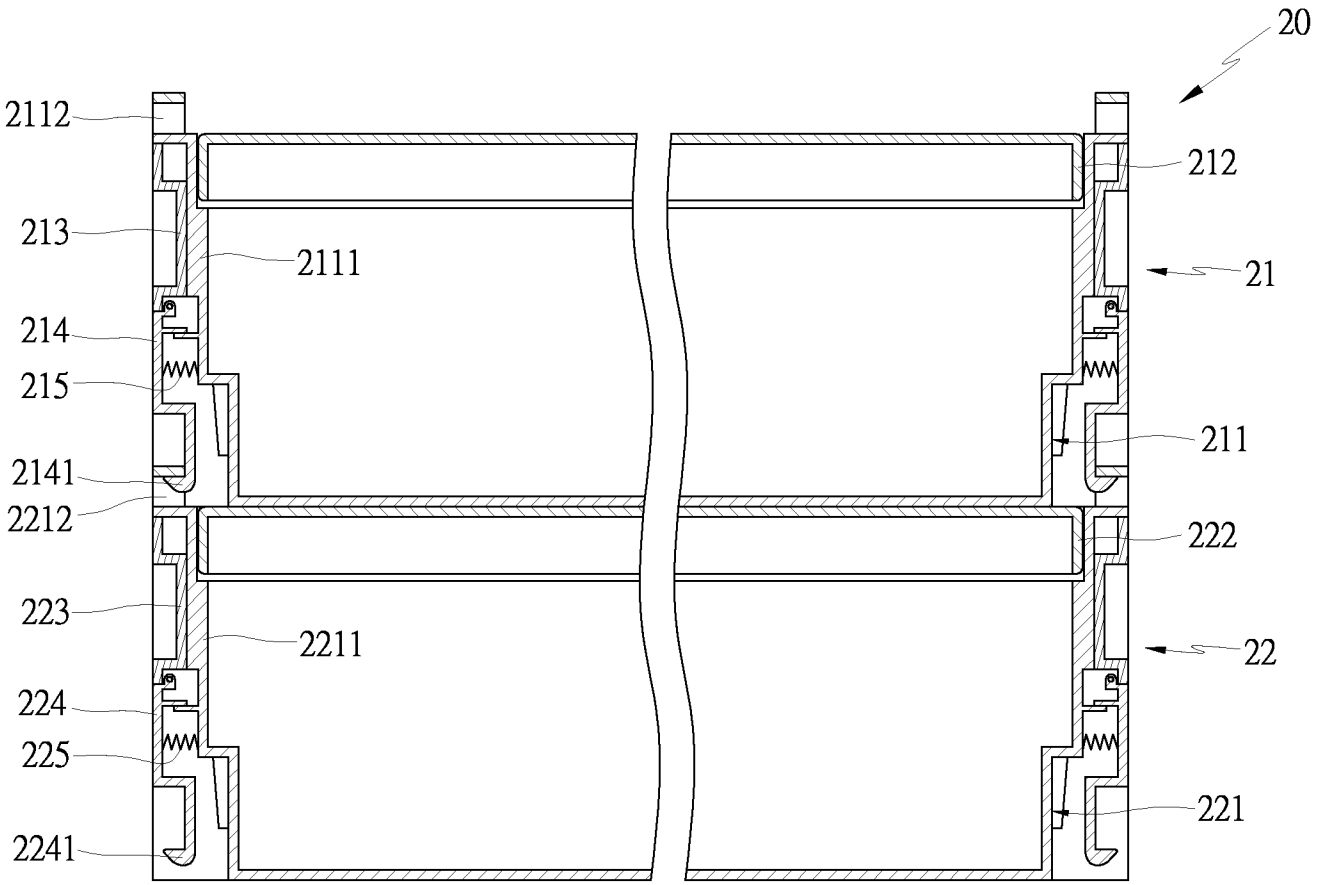
FIG. 3 PRIOR ART
FIG. 3 is a cross sectional view showing the operation of a conventional tool box assembly.
Figure 4:
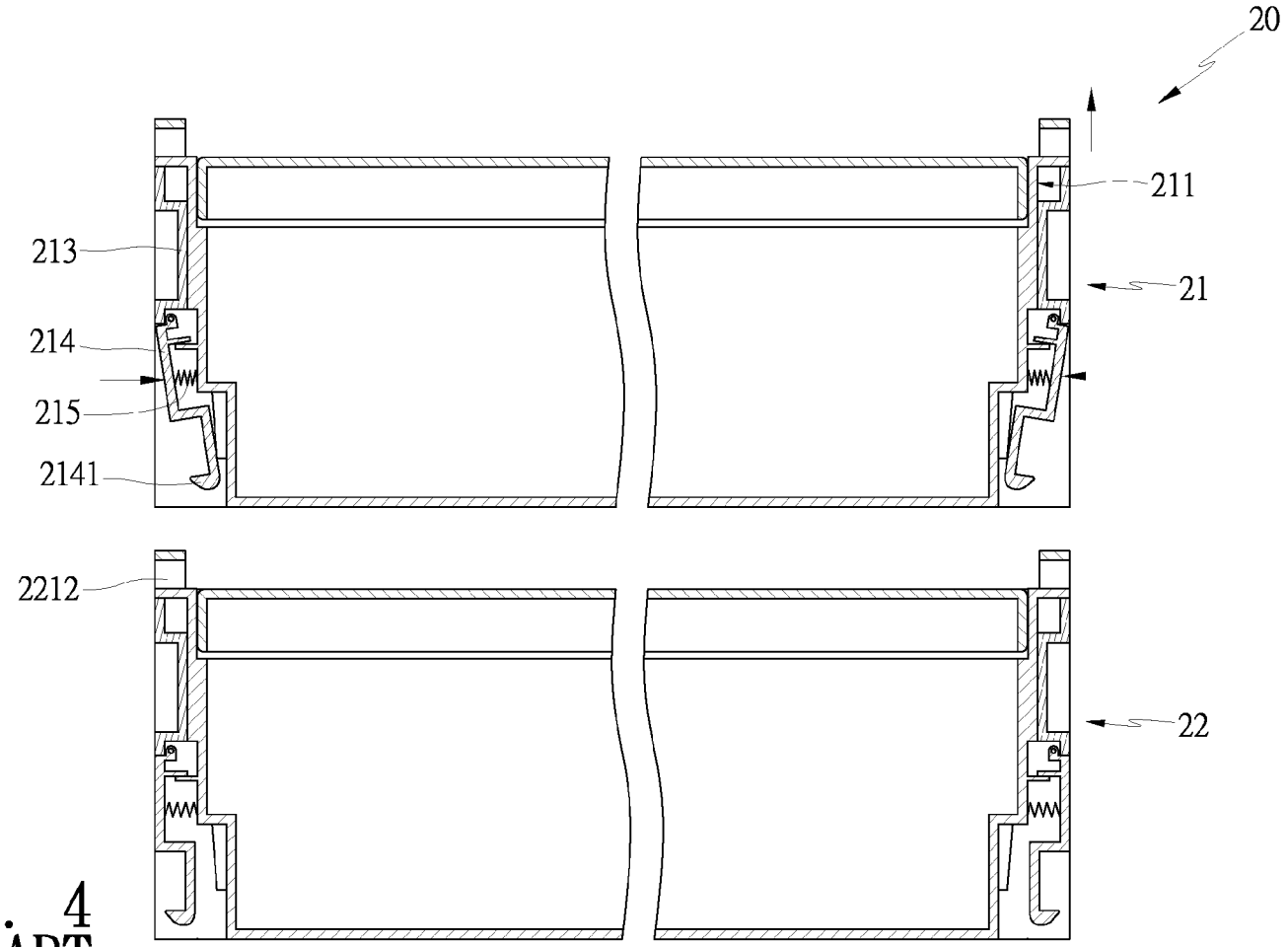
FIG. 4 PRIOR ART
FIG. 4 is another cross sectional view showing the operation of the conventional tool box assembly.
Figure 5:
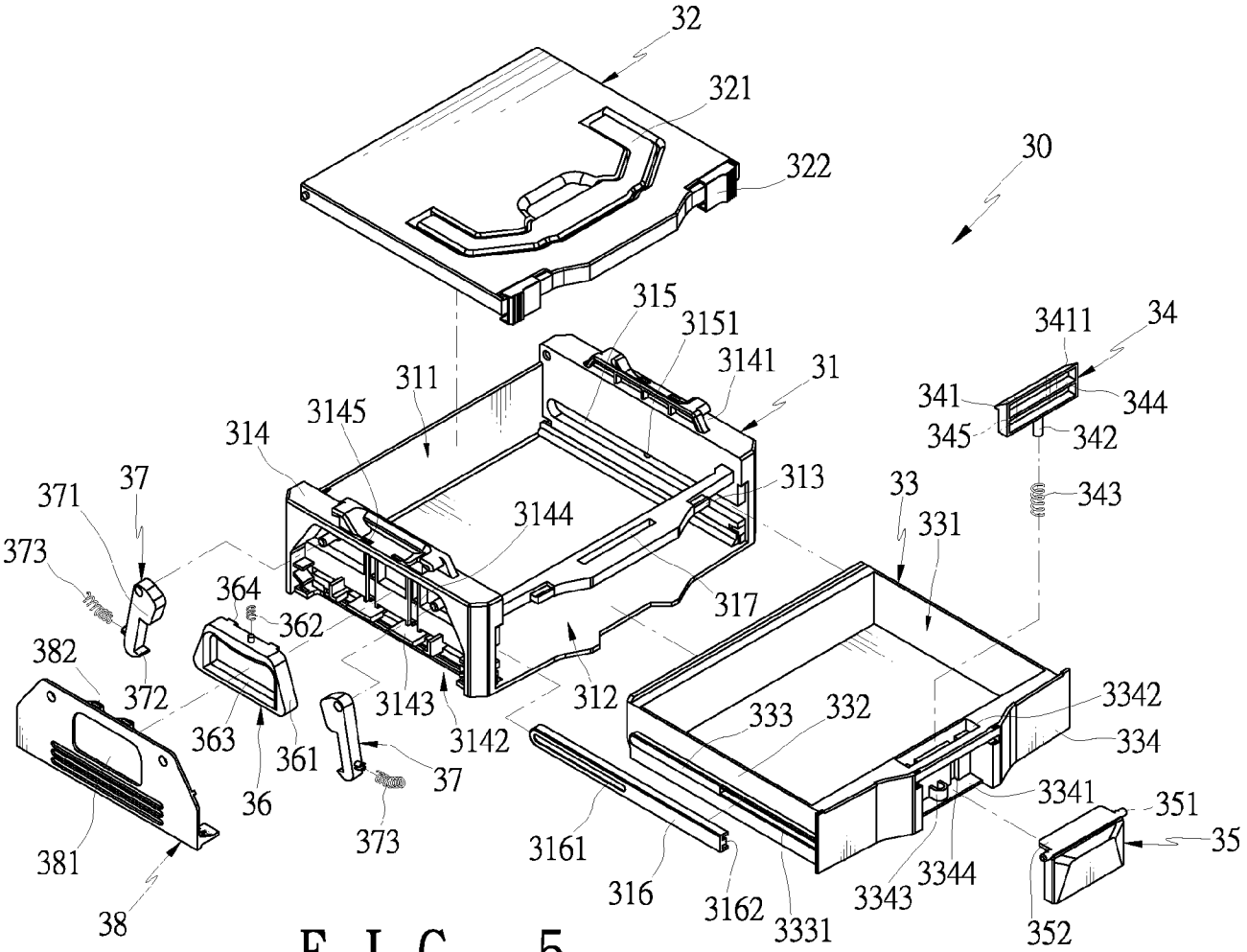
FIG. 5 is a perspective view showing the exploded components of a tool box unit according to a preferred embodiment of the present invention.
Figure 6:
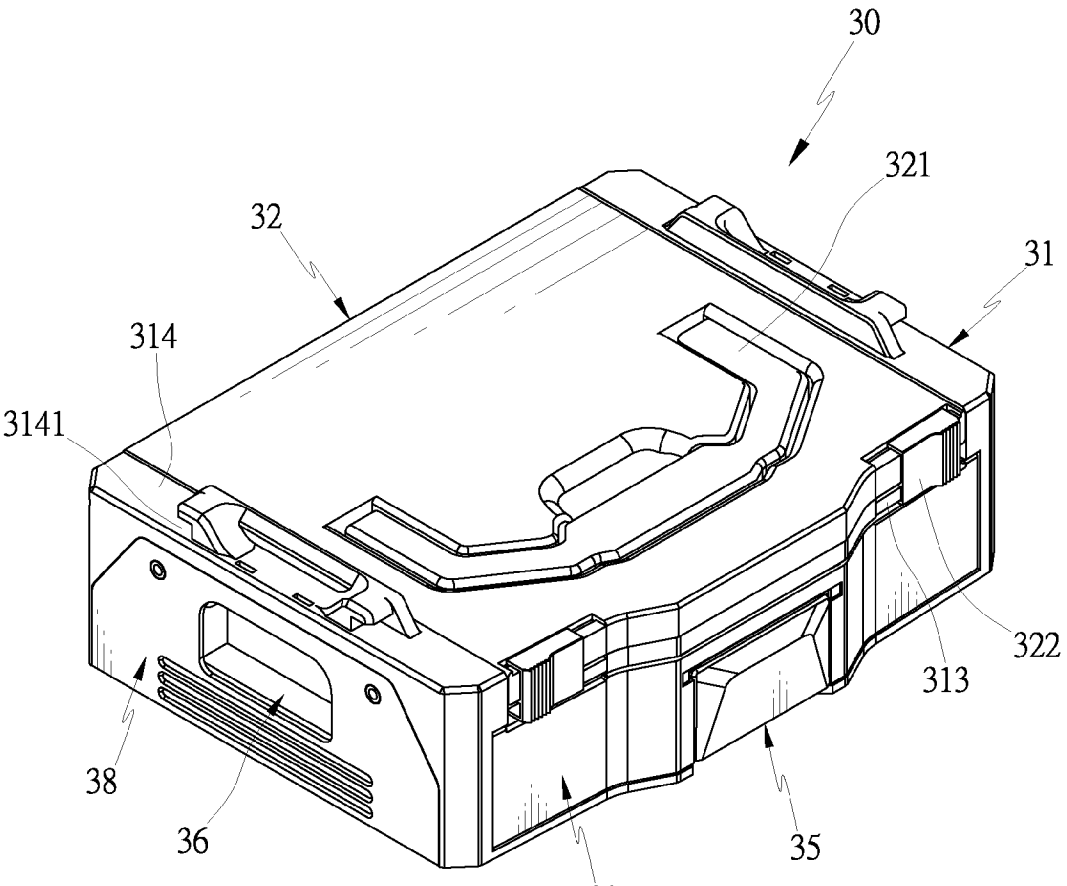
FIG. 6 is a perspective view showing the assembly of the tool box unit according to the preferred embodiment of the present invention.
Figure 7:
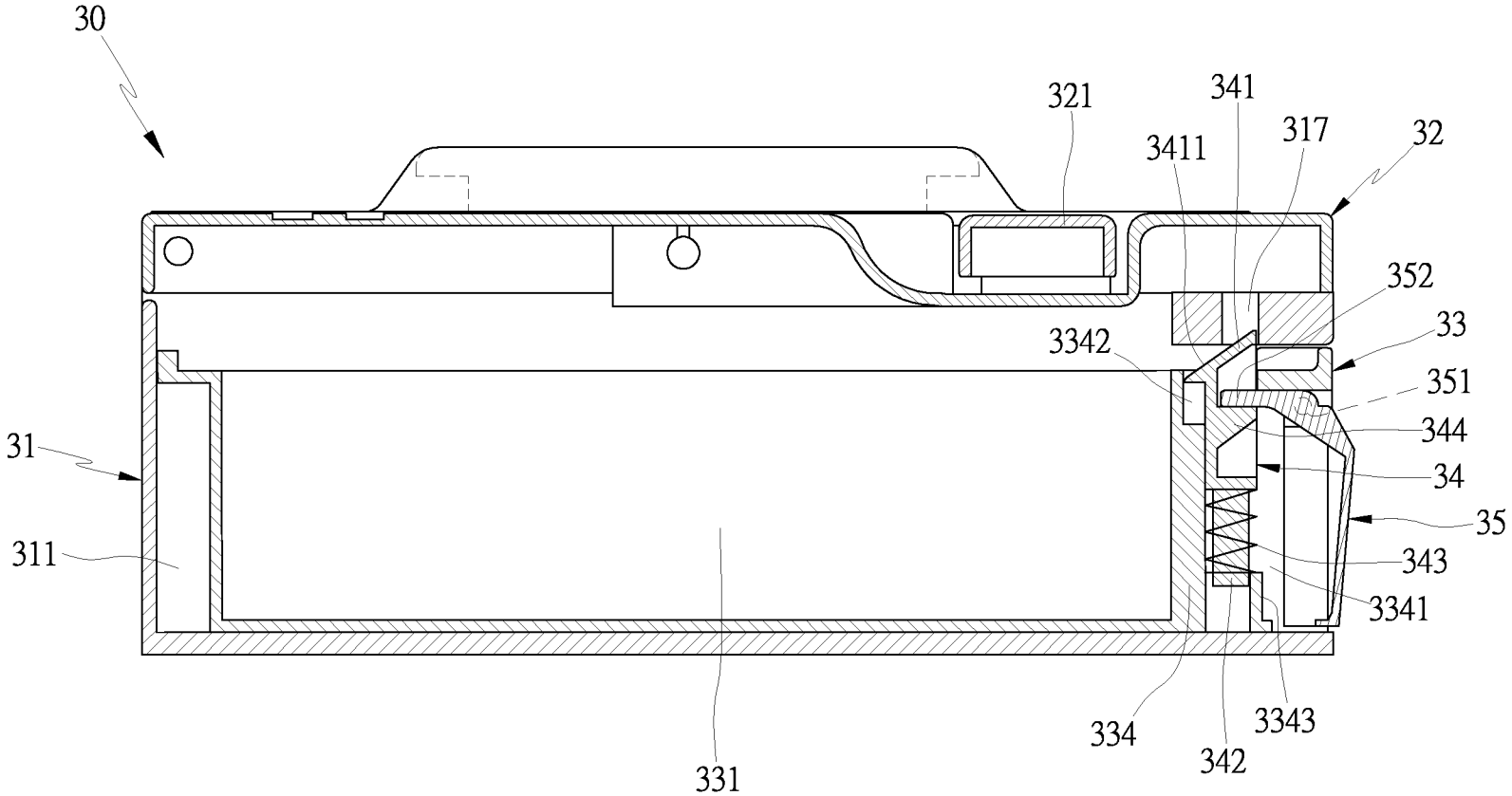
FIG. 7 is a cross sectional view showing the assembly of a part of the tool box unit according to the preferred embodiment of the present invention.
Figure 8:
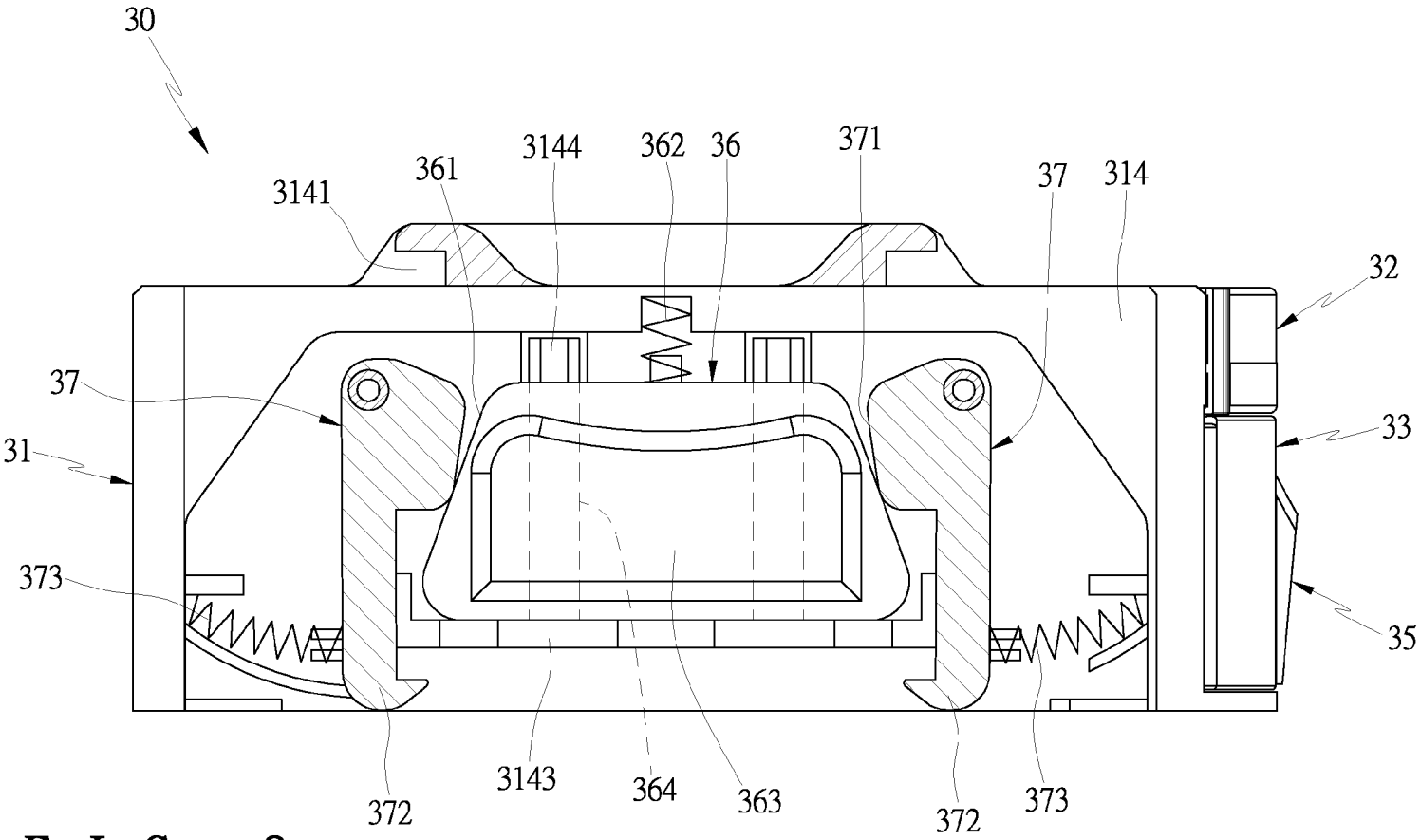
FIG. 8 is another cross sectional view showing the assembly of a part of the tool box unit according to the preferred embodiment of the present invention.
Figure 9:
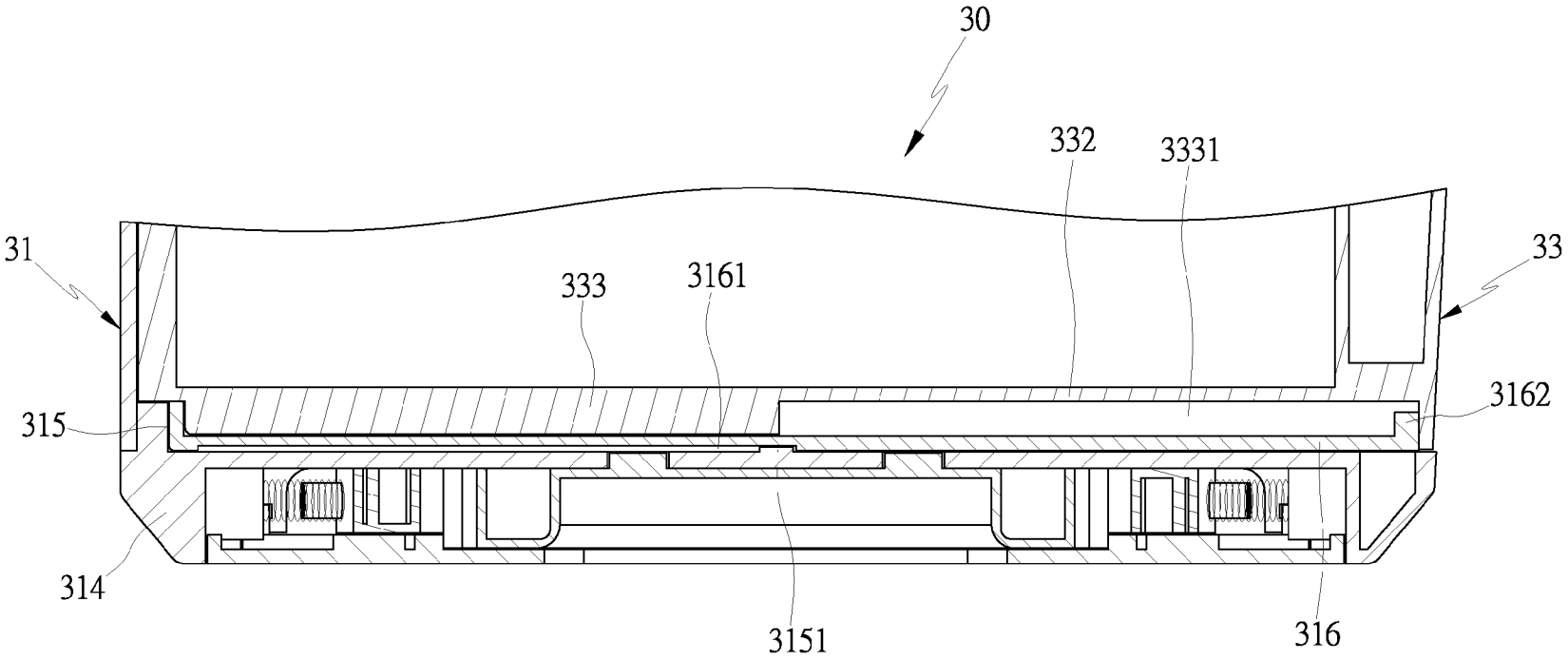
FIG. 9 is also another cross sectional view showing the assembly of a part of the tool box unit according to the preferred embodiment of the present invention.

With reference to FIGS. 5 to 9, a tool box unit 30 according to a first embodiment of the present invention comprises: a body 31, at least one upper cover 32, at least one drawer 33, and a controlling mechanism. The body 31 includes at least one accommodating space. In this embodiment, the body 31 includes a first accommodating space 311 defined therein and having an open top surface, and the body 31 also includes a through hole 312 formed on a front end thereof and communicating with the first accommodating space 311. The at least one upper cover 32 is rotatably fixed on an upper side of the body 31. In this embodiment, each upper cover 32 includes a handle 321 rotatably arranged on a top end thereof so that the tool box unit 30 is manually carried by gripping the handle 321. Between each upper cover 32 and the body 31 is defined a locking mechanism, and the locking mechanism has a first fastening member disposed on the body 31 and a second fastening member mounted on each upper cover 32 to fasten with or unfasten from the first fastening member. In this embodiment, the locking mechanism has at least one first fastening member 313 mounted on the front end of the body 31 and at least one slidable second fastening member 322 arranged on a predetermined position of each upper cover 32 corresponding to the at least one first fastening member 313 of the body 31, such that the at least one second fastening member 322 of each cover 32 slides to and fasten with the at least one first fastening member 313 of the body 31. The at least one drawer 33 is slidably fixed in the at least one accommodating space of the body 31 and has at least one receiving portion for accommodating tools. In this embodiment, a drawer 33 has a receiving portion 331 for accommodating the tools, and between the drawer 33 and the body 31 is defined a drawer slide, the drawer slide has an inner rack arranged on each of two first side plates 314 of the body 31, wherein the inner rack is an independent part or is defined on an inner surface of each first side plate 314. In this embodiment, each first side plate 314 of the body 31 has the inner rack 315 defined on the inner surface of each first side plate 314, and a middle rack 316 is slidably mounted in the inner rack 315, wherein between the middle rack 316 and the inner rack 315 are arranged a first slot and at least one first stop block for matching with the first slot. In this embodiment, the middle rack 316 has the first slot 3161 and a first stop block 3151 adjacent to a central position of the inner rack 315, wherein the first stop block 3151 is placed in the first slot 3161 of the middle rack 316, and an outer rack 333 is arranged outside each of two second side plates 332 of the drawer 33 and is fixed in the middle rack 316. Between the outer rack 333 and the middle rack 316 are defined a second slot and a second stop block for matching with the second slot. In this embodiment, the outer rack 333 has a second slot 3331 defined therein, and the middle rack 316 also has a second stop block 3162 arranged on a front end thereof and retained in the second slot 3331 of the outer rack 333, such that the drawer 33 is moved outwardly in a multi-section pulling manner by ways of the inner rack 315, the middle rack 316, and the outer rack 333. Between the body 31 and the drawer 33 is arranged an opening/closing mechanism, wherein the opening/closing mechanism includes at least one lock groove defined on the body 31, at least one retaining member disposed in the drawer 33, and at least one pull member for controlling the at least one retaining member to move so that the at least one retaining member retains with or removes from the at least one lock groove, thus opening or closing the drawer 33. In this embodiment, the opening/closing mechanism includes a lock groove 317 defined on a top surface of the though hole 312 of the body 31, a second accommodating space 3341 formed on a front sheet 334 of the drawer 33, an orifice 3342 corresponding to the lock groove 317 of the body 31 and communicating with the second accommodating space 3341, and a retaining member 34 mounted in the second accommodating space 3341 of the drawer 33. The retaining member 34 has at least one engaging portion, each having a guiding face; and the guiding face is a tilted surface or an arcuate surface. In this embodiment, the retaining member 34 has the engaging portion 341 arranged on a first end thereof, and the guiding face of the engaging portion is a tilted guiding surface 3411. Between a second end of the retaining member 34 and the drawer 33 is fixed a first resilient element (such as a spring) so that the retaining member 34 is pushed by the first resilient element to move upwardly. In this embodiment, the drawer 33 also has a seat 3343 secured on a bottom end of the second accommodating space 3341 of the front sheet 334, the retaining member 34 also has a post 342 fixed on the second end thereof and inserted into the seat 3343 of the drawer 33, and the retaining member 3 also has a first spring 343 fitted on the post 342, such that a first end of the first spring 343 abuts against the retaining member 34, and a second end of the first spring 343 contacts with the seat 3343 so that the first spring 343 pushes the retaining member 34 to move upwardly, and the engaging portion 341of the retaining member 34 extends out of the orifice 3342 of the drawer 33 to retain into the lock groove 317 of the body 31. Furthermore, the retaining member 34 further has a press projection 344 secured on a front end thereof, and the retaining member 34 and the second accommodating space 3341 of the front sheet 334 have a first sliding rail and a first sliding protrusion for cooperating with the first sliding rail. In this embodiment, the retaining member 34 has the first sliding protrusion 345 disposed on a rear end thereof, and the second accommodating space 3341 of the front sheet 334 has the first sliding rail 3344 mounted therein to accommodate the first sliding protrusion 345. In addition, a pull member 35 is rotatably connected with the drawer 33 and has at least one pressing piece for pressing the retaining member 34 to move downwardly. In this embodiment, two sides of the pull member 35 are rotatably connected with two sides of the accommodating space 3341 of the drawer 33 by using two connecting shafts 351, and the pull member 35 has a pressing piece 352 for contacting with the press projection 344 of the retaining member 34, such that when the retaining member 34 moves upwardly, the press projection 344 pushes the pressing piece 352 of the pull member 35 to swing upwardly, and the pull member 35 swing downwardly along the two connecting shafts 351, thus closing the second accommodating space 3341 of the drawer 33. The controlling mechanism includes at least one trench formed on the two first side plates 314 of the body 31, and each trench has a control member 36 fixed therein and at least one hooking element 37 rotatably connected with each first side plate 314. The control member 36 has at least one oblique push face for pushing the at least one hooking element 37 to rotate, thereby opening/closing the at least one hooking element 37. In this embodiment, each first side plate 314 of the body 31 has a trench 3141 formed on a top surface thereof and a third accommodating space 3142 defined therein, and the third accommodating space 3142 has at least one holding sheet 3143 for holding the control member 36. The control member 36 has two tilted driving faces 361 arranged on a front end and a rear end thereof, and between the top surface of the control member 36 and a top surface of the third accommodating space 3142 is defined a second resilient element (such as a second spring), wherein the second spring 362 pushes the control member 36 to move downwardly to an original position, and the control member 36 has a gripping portion 363 defined on an outer peripheral side thereof, and between an inner surface of the control member 36 and a side surface of the third accommodating space 3142 are arranged at least one second sliding rail and at least one second sliding protrusion for cooperating with the at least one second sliding rail. In this embodiment, the control member 36 has two second sliding protrusions 364 disposed on the inner surface thereof, and the third accommodating space 3142 of the body 31 has two second sliding rails 3144 for receiving the two second sliding protrusions 364. The control member 36 also has two hooking elements 37 mounted on the front end and the rear end thereof and rotatably coupled with each side plate 314, wherein each hooking element 37 has an abutting portion 371 formed on a first end thereof to contact with each of the two tilted driving faces 361. Each hooking element 37 also has a hook portion 372 secured on a second end thereof. Between each hooking element 37 and the third accommodating space 3142 is defined a third resilient element (such as a third spring 373), such that the first spring 373 pushes each hooking element 37 to move back to an original position. The body 31 further includes two lids 38 disposed on two sides thereof to cover the third accommodating space 3142, thus preventing a removal of the control member 36, each holing element 37, and the third spring 373 from the body 31. In this embodiment, each lid 38 has an aperture 381 defined thereon so that user's hand inserts into the body 31 to control the control member 36. Between each lid 38 and each first side plats 314 of the body 31 are defined at least one positioning piece and at least one fixing opening so that each lid 38 is mounted on each of the two sides of the body 31. In this embodiment, the third accommodating space 3142 has plural fixing openings 3145 arranged on the top surface and a bottom surface thereof, and each lid 38 has plural positioning pieces 382 fixed on a top end and a bottom end thereof to correspond to the plural fixing openings 3145, such that the plural positioning pieces 382 of each lid 38 retain with the plural fixing openings 3145 of the body 31, thereby fixing each lid 38 and the body 31 together.

Figure 10:
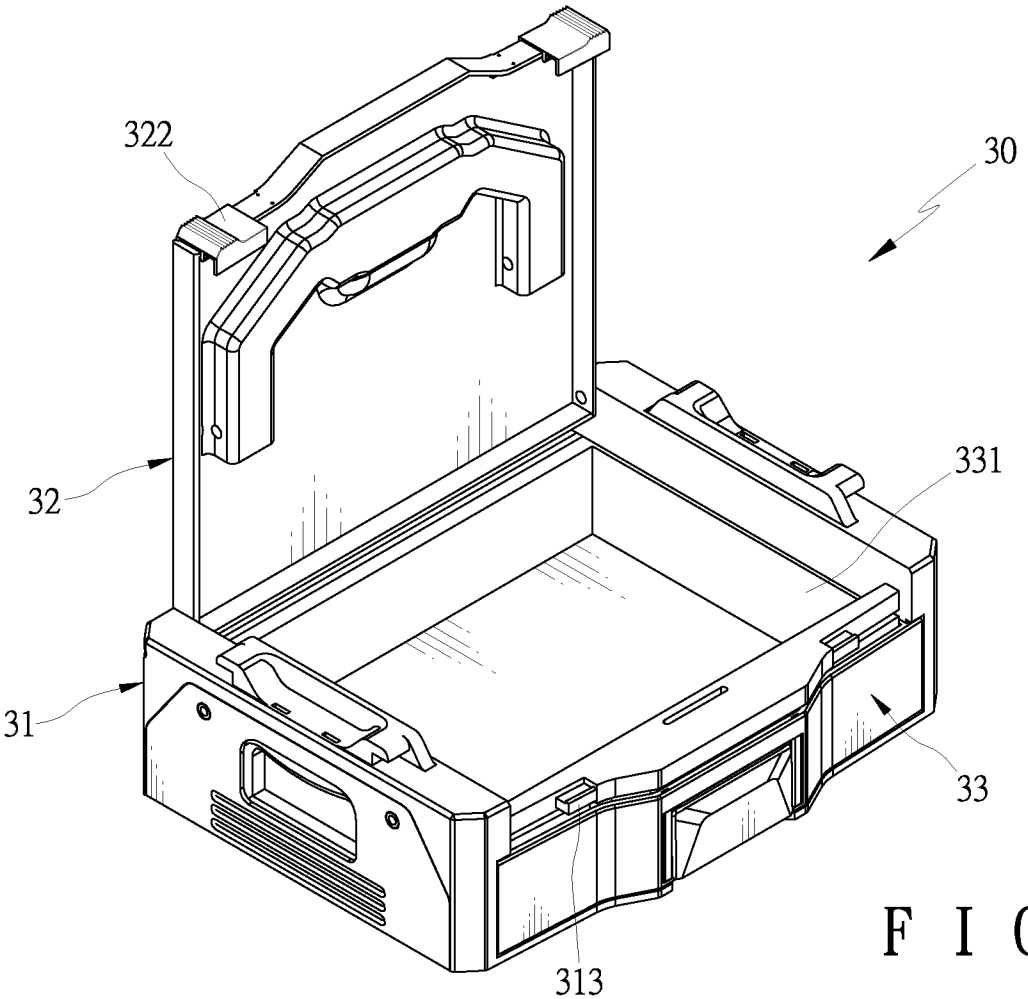
FIG. 10 is a perspective view showing the operation of the tool box unit according to the preferred embodiment of the present invention.

Referring further to FIG. 10, the tool box unit 30 has an upper cover 32 mounted on the upper side of the body 31 to avoid a removal of the tools from the drawer 33, and the tool box unit 30 is opened by opening the upper cover 32 upwardly or by pulling the drawer 33 forwardly, thus taking out or placing the tools. When the user is desired to open the upper cover 32 to take out the tools, the at least one slidable second fastening member 322 of the upper cover 32 is pushed horizontally to unfasten from the at least one first fastening member 313, thus opening the upper cover 32 and taking the tools out of the receiving portion 331 of the drawer 33.

Figure 11:
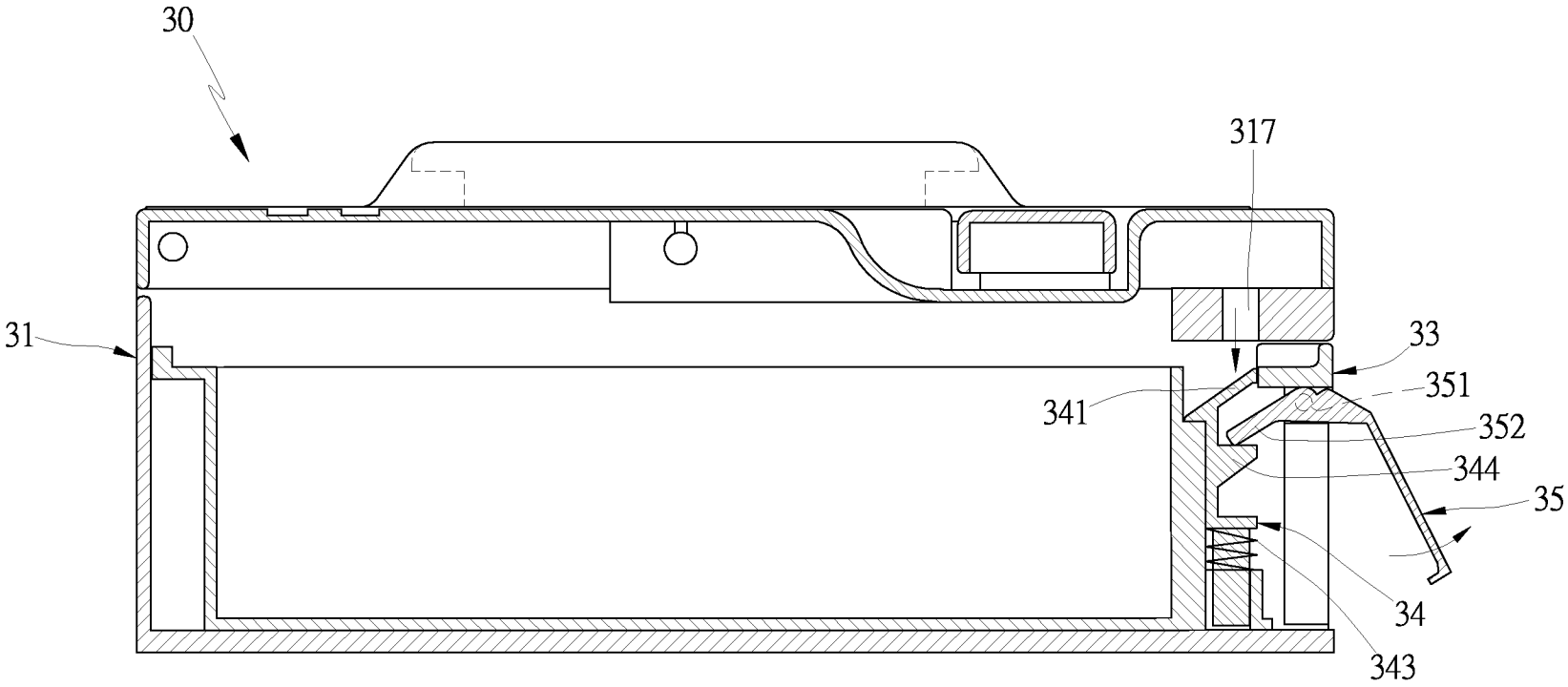
FIG. 11 is a cross sectional view showing the operation of the tool box unit according to the preferred embodiment of the present invention.

As shown in FIG. 11, when the user intends to open the drawer 33 and take out the tools, the pull member 35 of the drawer 33 is pulled to upwardly rotate along the two connecting shafts 351, and the pressing piece 352 swings downwardly and presses the press projection 344 of the retaining member 34 so that the retaining member 34 moves downwardly to press the first spring 343, and the engaging portion 341 of the retaining member 34 removes from the lock groove 317 of the body 31, thus opening the drawer 33.

Figure 12:
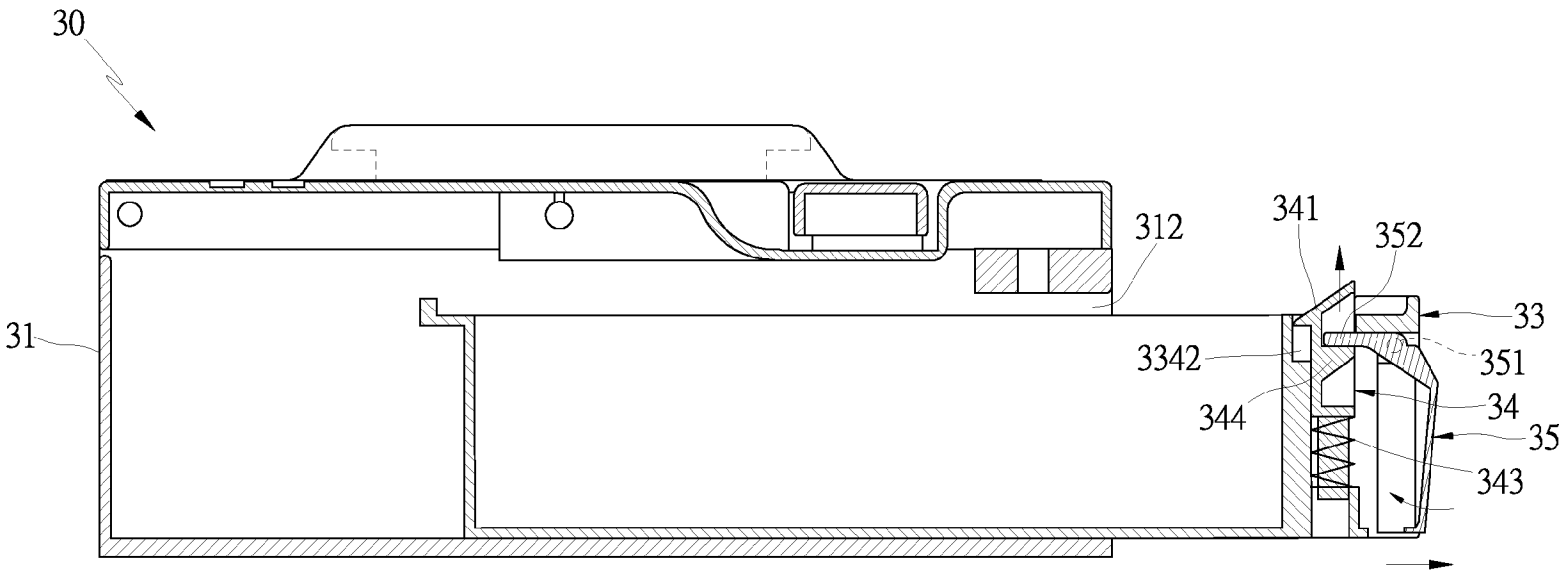
FIG. 12 is another cross sectional view showing the operation of the tool box unit according to the preferred embodiment of the present invention.
Figure 13:
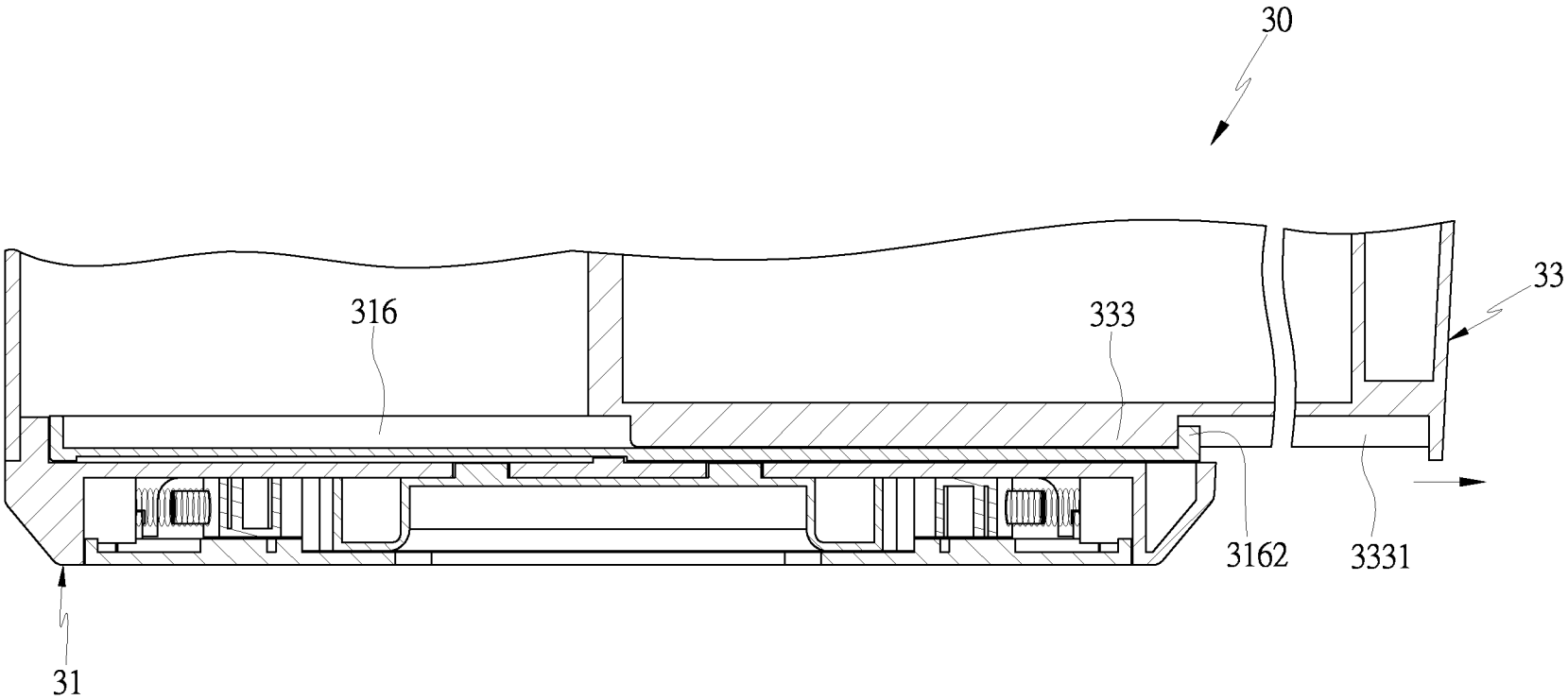
FIG. 13 is also another cross sectional view showing the operation of the tool box unit according to the preferred embodiment of the present invention
Figure 14:
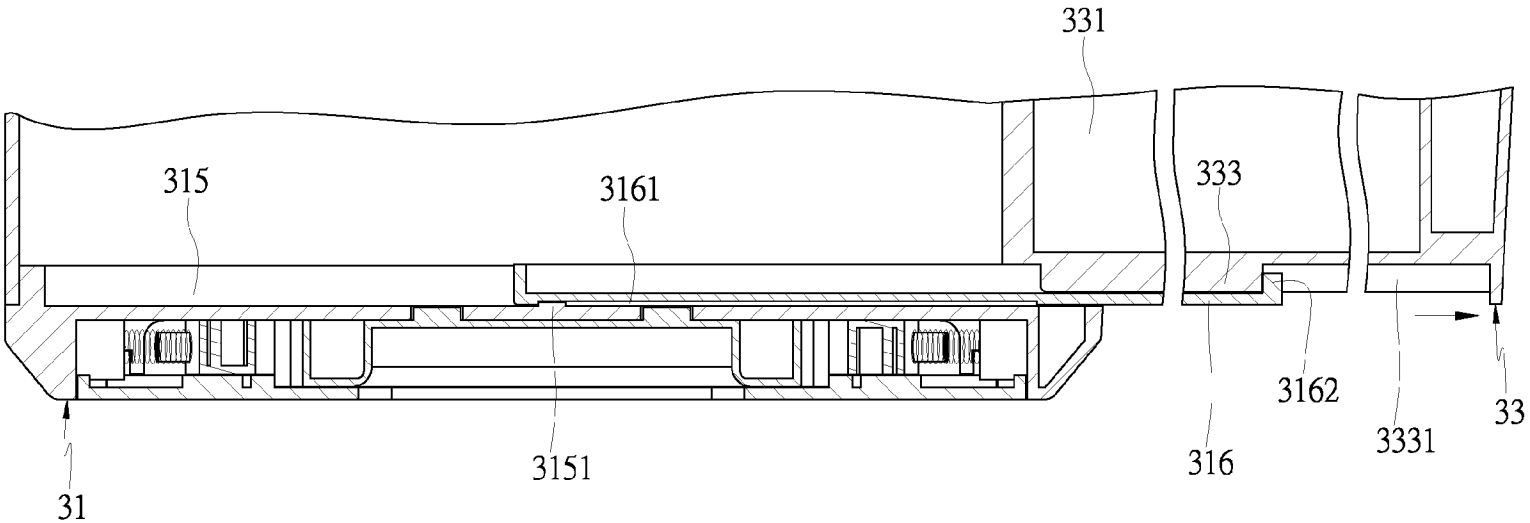
FIG. 14 is still another cross sectional view showing the operation of the tool box unit according to the preferred embodiment of the present invention.

As illustrated in FIGS. 12 to 14, after the user pulls the drawer 33 outwardly, the drawer 33 slides out of the through hole 312 to release the pull member 35, and the retaining member 34 is pushed by the first spring 343 to move upwardly so that the engaging portion 341 extends out of the orifice 3342 of the drawer 33, and the press projection 344 pushes the pressing piece 352 of the pull member 35 to swing upwardly so that the pull member 35 swings downwardly along the two connecting shafts 351, and when the drawer 33 moves outwardly, it drives the outer rack 333 on each of two sides of the drawer 33 to move simultaneously. When an end portion of the second slot 3331 abuts against the second stop block 3162 of the middle rack 316, and the drawer 33 is pulled outward continuously, the end portion of the second slot 3331 and the second stop block 3162 drive the middle rack 316 to move outwardly along the inner rack 315, and when an end portion of the first slot 3161 of the middle rack 316 is biased against the first stop block 3151, the middle rack 316 is fixed, thus preventing a removal of the drawer 33 from the body 31 and adjusting a pulling length of the drawer 33 in the multi-section pulling manner. Accordingly, the user takes the tools out of the receiving portion 331 of the drawer 33 or places the tools back to the receiving portion 331 easily.

Figure 15:
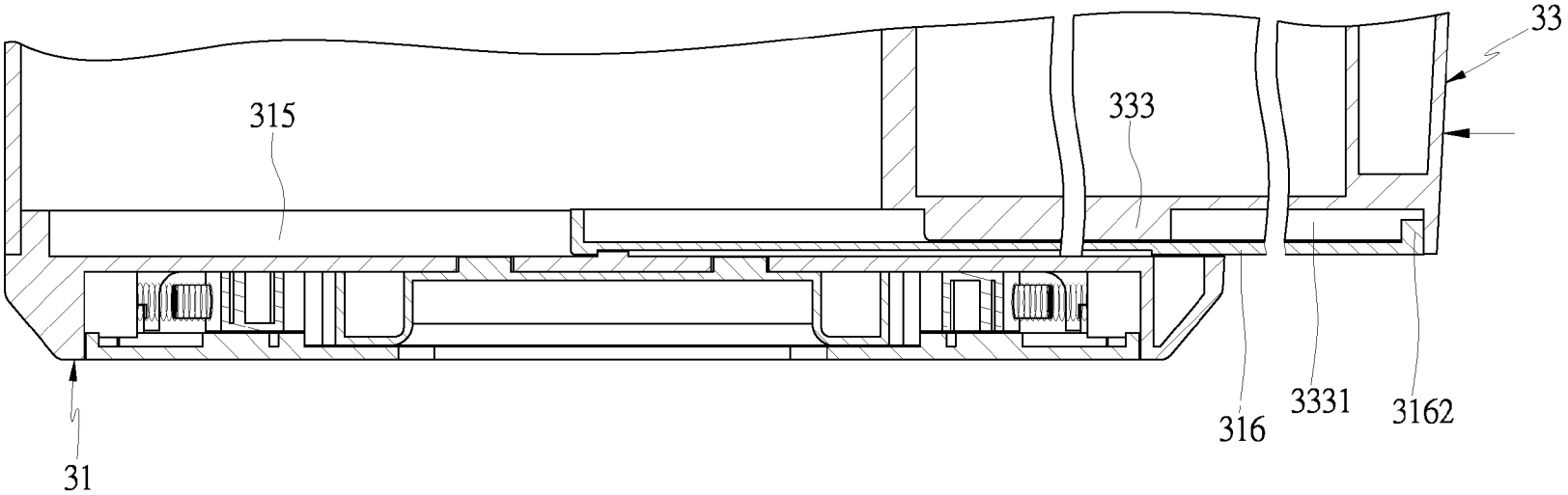
FIG. 15 is another cross sectional view showing the operation of the tool box unit according to the preferred embodiment of the present invention
Figure 16:
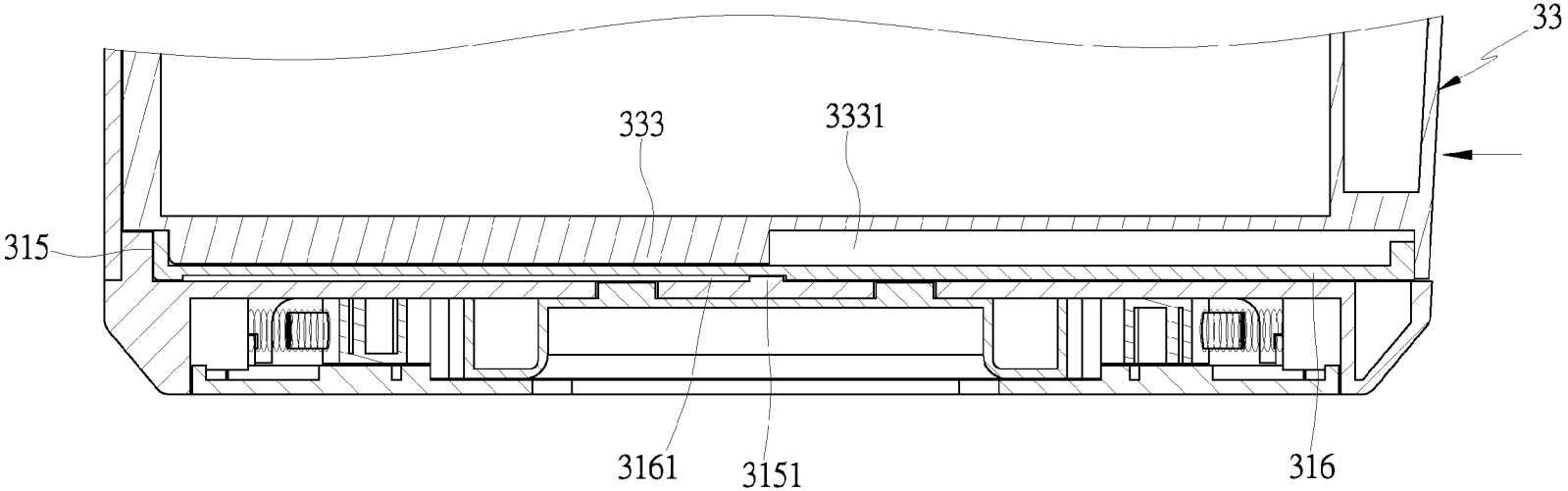
FIG. 16 is also another cross sectional view showing the operation of the tool box unit according to the preferred embodiment of the present invention.
Figure 17:
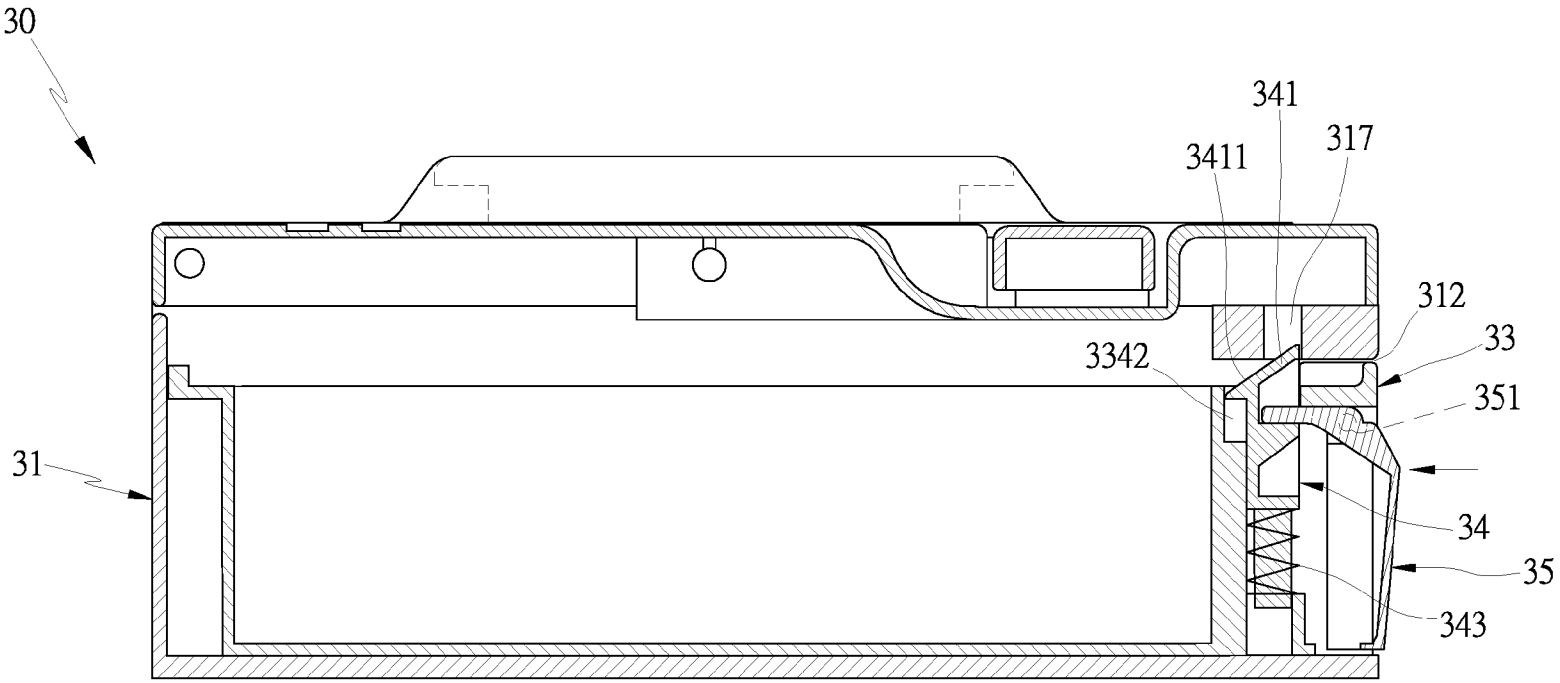
FIG. 17 is still another cross sectional view showing the operation of the tool box unit according to the preferred embodiment of the present invention.

With reference to FIGS. 15 to 17, as desiring to close the drawer 33, the outer racks 333 on each of the two sides of the drawer 33 drive the middle rack 316 to move by ways of the second stop block 3162, and the middle rack 316 moves inwardly along the inner rack 315. When the drawer 33 is pushed backward continuously, the first slot 3161 of the middle rack 316 abuts against the first stop block 3151 of the inner rack 315 to limit the middle rack 316, such that the drawer 33 is retracted in the body 31. Due to the engaging portion 341 of the retaining member 34 extends out of the orifice 3342 of the drawer 33, the pull member 35 is not pulled by the user as the drawer moves into the body 31, and the tilted guiding surface 3411 of the engaging portion 341 is pressed by the through hole 312 to move downwardly, and when the engaging portion 341 corresponds to the lock groove 317, the first spring 343 pushes the retaining member 34 so that the engaging portion 341 extends out of the orifice 3342 of the drawer 33 and retains into the lock groove 317 of the body 31, thus fixing and closing the drawer 33 in the body 31.

Figure 18:
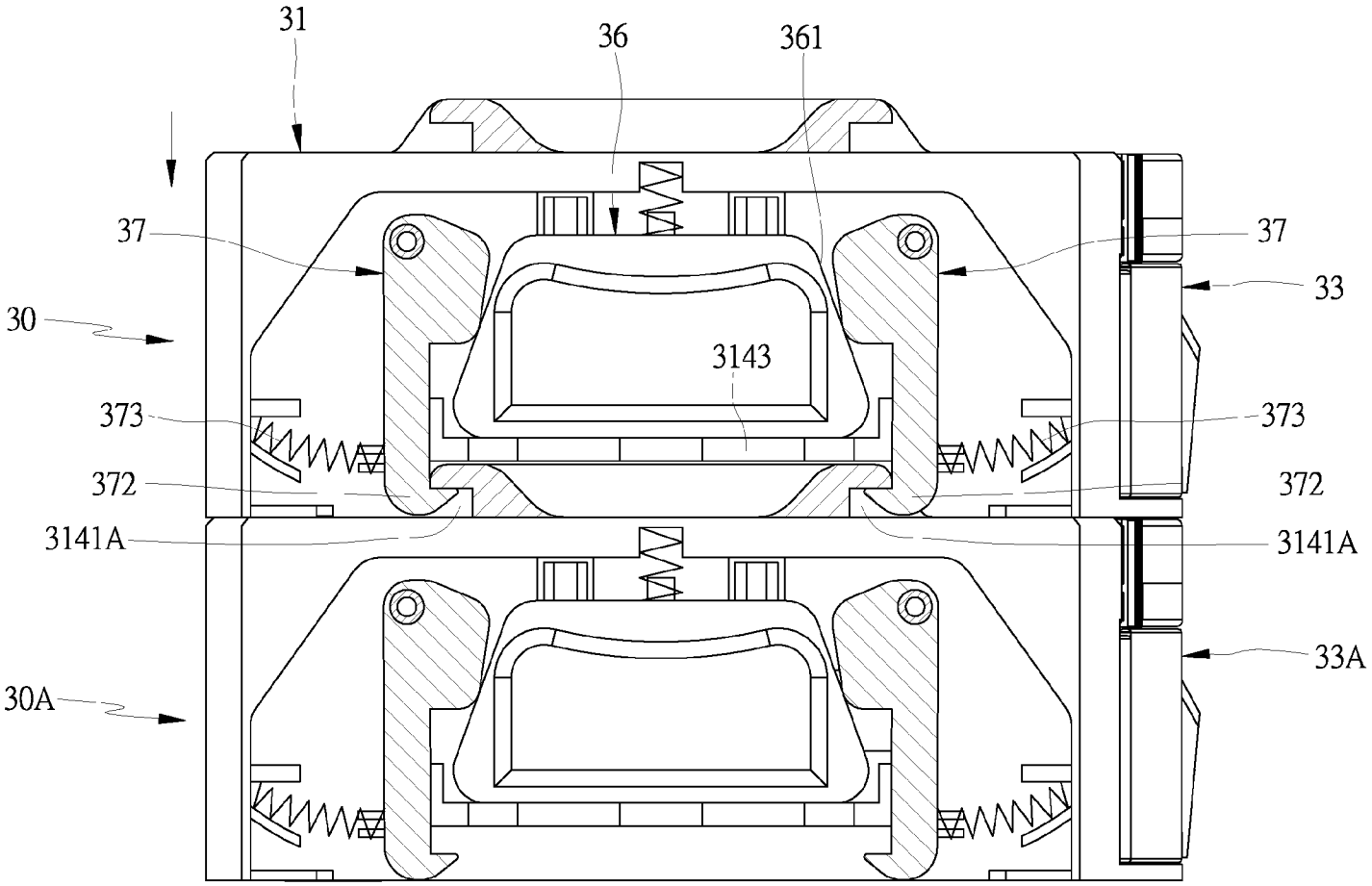
FIG. 18 is a cross sectional view showing two tool box units being piling together according to the preferred embodiment of the present invention.

As shown in FIG. 18, a plurality of tool box units 30, 30A are piled together, wherein the control member 36 is moved downwardly to fix on the at least one holding sheet 3143, and the two tilted driving faces 361 of the control member 36 do not push the two hooking elements 37 to swing outwardly, so the hook portion 372 of each hooking element 37 of a first tool unit 30 is pushed by a trench 3141A of a second tool box unit 30A so that each hooking element 37 swings outwardly, and when the hook portion 372 corresponds to the trench 3141A, the third spring 373 pushes each hooking element 37 to swing inwardly and to retain in the trench 3141A of the second tool box unit 30A so that the first tool box unit 30 and the second tool box unit 30 A are fixed together to place the tools. Because the first tool box unit 30 and the second tool box unit 30 A have a first drawer 33 and a second drawer 33A, the user can pull the drawer easily.

Figure 19:
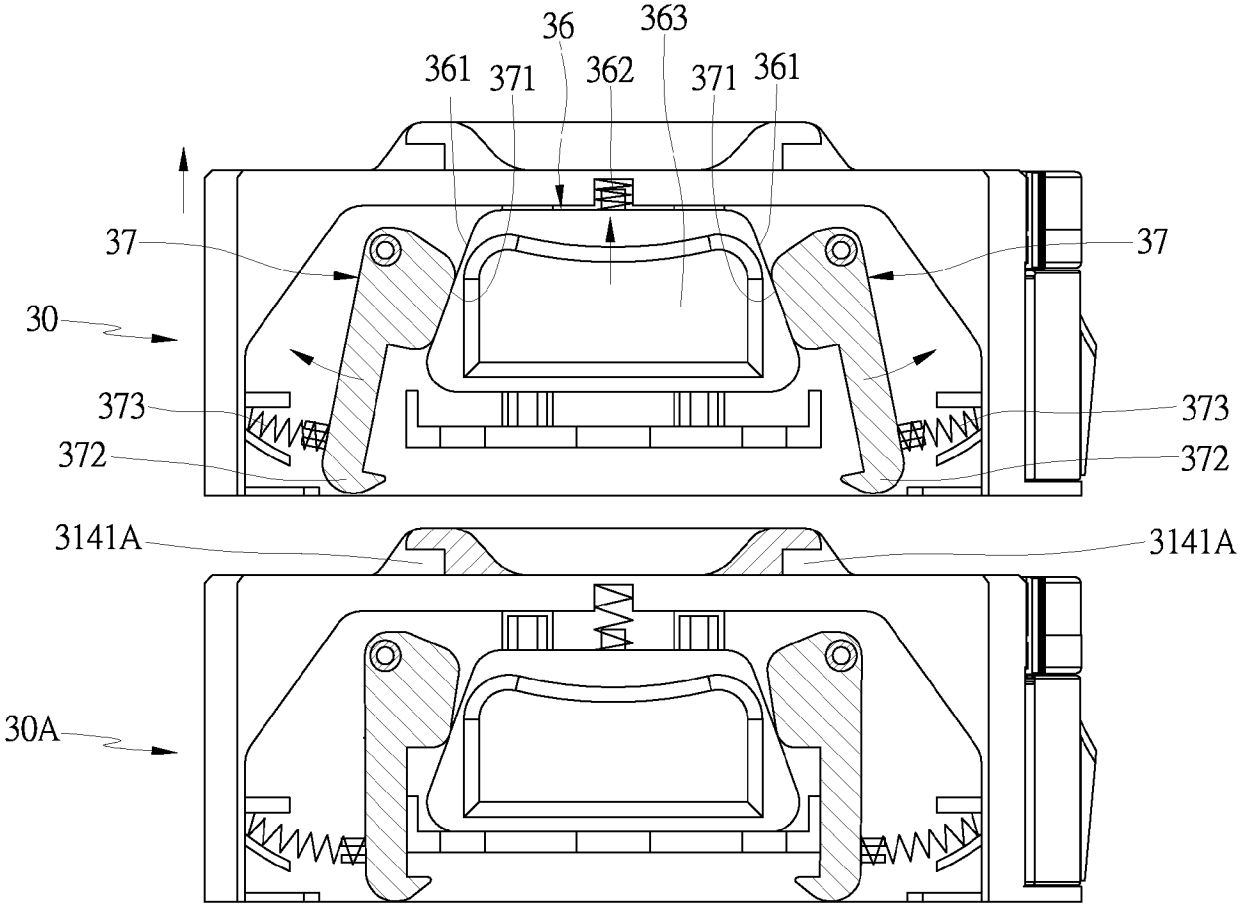
FIG. 19 is a cross sectional view showing the two tool box units being separated from each other according to the preferred embodiment of the present invention.

As illustrated in FIG. 19, as desiring to remove the first tool box unit 30 from the second tool box unit 30A, the gripping portion 363 of the control member 36 of the first tool box unit 30 is gripped by the user, and the control member 36 is pulled upwardly to press the second spring 362, thereafter the two tilted driving faces 361 of the control member 36 push two abutting portions 371 of the two hooking elements 37 so that the two hooking elements 37 swing outwardly and press the third spring 373, and two hook portions 372 of the two hooking elements 37 remove from the trench 3141A of the second tool box unit 30A, the control member 36 is pulled upwardly to open the two hooking elements 37, thus removing the first tool box unit 30 from the second tool box unit 30A easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool box unit comprising:

a body including at least one first accommodating space defined therein;

at least one upper cover rotatably fixed on an upper side of the body;

at least one drawer slidably fixed in the at least one first accommodating space of the body and having at least one receiving portion for accommodating tools;

a controlling mechanism including at least one trench formed on each of two first side plates of the body, and wherein each said first side plate has a third accommodating space defined therein and below the at least one trench as to accommodate a control member and at least one hooking element rotatably connected with each said first side plate, each at least one hooking element has a hook portion secured on a first end thereof and has an abutting portion formed on a second end thereof, wherein between each said hooking element and the third accommodating space of the body is defined a third resilient element, the control member has at least one oblique push face, and each at least one oblique push face of the control member contacts with the abutting portion of a corresponding said hooking element, and when the control member is pulled upwardly, each said oblique push face of the control member pushes the abutting portion of said corresponding hooking element so that said hooking element rotates.

2. The tool box unit as claimed in claim 1, wherein between each of the at least one upper cover and the body is defined a locking mechanism, and the locking mechanism has a first fastening member disposed on the body and has a second fastening member mounted on said each upper cover so as to fasten with or unfasten from the first fastening member.

3. The tool box unit as claimed in claim 1, wherein between each of the at least one drawer and the body is defined a drawer slide, the drawer slide has an inner rack arranged on said each first side plates of the body, a middle rack slidably mounted in the inner rack, wherein between the middle rack and the inner rack are arranged a first slot and at least one first stop block for matching with the first slot, and an outer rack is arranged outside said each first side plate of said each drawer and is fixed in the middle rack, between the outer rack and the middle rack are defined a second slot and a second stop block for matching with the second slot.

4. The tool box unit as claimed in claim 1, wherein between the body and said each drawer is arranged an opening and closing mechanism, wherein the opening and closing mechanism includes at least one lock groove defined on the body, at least one retaining member disposed in said each drawer, and at least one pull member for controlling the at least one retaining member to move, each of the at least one retaining member has at least one engaging portion arranged on a first end thereof so as to retain in or remove from the at least one lock groove, and each of the at least one pull member has a pressing piece for contacting with said each retaining member.

5. The tool box unit as claimed in claim 4, wherein the opening and closing mechanism includes a second accommodating space formed on a front sheet of said each drawer so as to accommodate said each retaining member, between a second end of said each retaining member and said each drawer is fixed a first resilient element, said each retaining member further has a press projection secured on a front end thereof, said each pull member is rotatably connected with said each drawer and has at least one pressing piece for pressing the press projection of said each retaining member.

6. The tool box unit as claimed in claim 1, wherein the control member has a gripping portion defined on an outer peripheral side thereof, and the body further includes two lids disposed on two sides thereof, and each of the two lids has an aperture defined thereon, between each said lid and each said first side plate of the body are defined at least one positioning piece and at least one fixing opening.

7. The tool box unit as claimed in claim 1, wherein between a top surface of the control member and a top surface of the third accommodating space is defined a second resilient element.

8. The tool box unit as claimed in claim 1, wherein between an inner surface of the control member and a side surface of the third accommodating space are arranged at least one second sliding rail and at least one second sliding protrusion for cooperating with the at least one second sliding rail.

9. A tool box assembly being comprised of multiple tool box units which are staked together, wherein each box unit comprises:

a body including at least one first accommodating space defined therein;

at least one upper cover rotatably fixed on an upper side of the body;

at least one drawer slidably fixed in the at least one first accommodating space of the body and having at least one receiving portion for accommodating tools; and a controlling mechanism including at least one trench formed on each of two first side plates of the body, wherein each said first side plate has a third accommodating space defined therein and below the at least one trench as to accommodate a control member and at least one hooking element rotatably connected with each said first side plate, each at least one hooking element has a hook portion secured on a first end thereof and has an abutting portion formed on a second end thereof, wherein between each said hooking element and the third accommodating space of the body is defined a third resilient element, the control member has at least one oblique push face, and each at least one oblique push face of the control member contacts with the abutting portion of a corresponding said hooking element, and when the control member is pulled upwardly, each said oblique push face of the control member pushes the abutting portion of said corresponding hooking element so that said hooking element rotates.

10. The tool box assembly as claimed in claim 9, wherein at least one hooking element of an upper one of the multiple tool box units retains with at least one trench of a lower one of the multiple tool box units.

* * * * *